United States Patent [19]

Kwasnitza

[11] Patent Number: 4,702,135

[45] Date of Patent: Oct. 27, 1987

[54] APPARATUS FOR ZIG-ZAG FOLDING OF PAPER WEBS AND THE LIKE

[75] Inventor: Hans D. Kwasnitza, Neuffen, Fed. Rep. of Germany

[73] Assignee: Womako Maschinenkonstruktionen GmbH, Nürtingen, Fed. Rep. of Germany

[21] Appl. No.: 883,625

[22] Filed: Jul. 9, 1986

[30] Foreign Application Priority Data

Jul. 18, 1985 [DE] Fed. Rep. of Germany ..... 3525640
Mar. 29, 1986 [DE] Fed. Rep. of Germany ..... 3610640

[51] Int. Cl.[4] ..... B65H 45/28; B65H 45/20; B26D 5/20

[52] U.S. Cl. ..... 83/278; 83/402; 83/92; 493/357; 493/358; 493/410

[58] Field of Search ..... 493/343, 356, 357, 358, 493/359, 410, 411, 412, 413, 414, 415; 83/278, 402

[56] References Cited

U.S. PATENT DOCUMENTS

| | | | |
|---|---|---|---|
| 2,675,747 | 4/1954 | Greiner et al. | 493/360 |
| 3,301,111 | 1/1967 | Nystrand | 83/92 |
| 4,205,836 | 6/1980 | Nystrand | 493/357 |
| 4,406,650 | 9/1983 | Felix | 493/412 |
| 4,460,350 | 7/1984 | Mittal et al. | 493/412 |
| 4,507,109 | 3/1985 | Meschi | 493/356 |
| 4,508,527 | 4/1985 | Uno et al. | 493/357 |
| 4,618,340 | 10/1986 | Meschi | 493/13 |

FOREIGN PATENT DOCUMENTS

| | | | |
|---|---|---|---|
| 2264633 | 7/1974 | Fed. Rep. of Germany | 493/358 |
| 2533434 | 2/1977 | Fed. Rep. of Germany | 493/418 |
| 22384 | 12/1961 | German Democratic Rep. | 493/413 |

*Primary Examiner*—Robert P. Olszewski
*Assistant Examiner*—William E. Terrell
*Attorney, Agent, or Firm*—Peter K. Kontler

[57] ABSTRACT

An apparatus for converting a continuous paper web with transversely extending weakened zones into successive stacks of overlapping panels in zig-zag formation has two endless foraminous belt conveyors with divergent active reaches which attract alternate panels of the running web and advance alternate weakened zones into the range of the flights of two spiral conveyors. The spiral conveyors terminate the change of orientation of oncoming panels and deposit the panels on a vertically movable support whereon the panels accumulate into a stack. When the number of panels in a stack reaches a predetermined value, a nozzle admits compressed air between the topmost panel of the stack and the next-following panel so as to open the zig-zag formation and permit insertion of a table having a slot for a reciprocable knife which severs the web along the fold line between the topmost panel of the stack and the next-following panel. One of the spiral conveyors is arrested during introduction of the table into the gap between the two neighboring panels. Stops are disposed between the discharge ends on the active reaches of the foraminous conveyors and the adjacent spiral conveyors to promote the folding of panels relative to each other as well as to prevent lateral stray movements of the panels on their way toward the support.

5 Claims, 7 Drawing Figures

APPARATUS FOR ZIG-ZAG FOLDING OF PAPER WEBS AND THE LIKE

BACKGROUND OF THE INVENTION

The invention relates to apparatus for converting a continuous web of coherent panels of paper or the like into a series of stacks wherein the panels are accumulated in zig-zag formation. The invention also relates to apparatus for subdividing a continuously growing larger stack of panels which are assembled in zig-zag formation into a succession of smaller stacks containing predetermined numbers of overlapping panels.

German Offenlegungsschrift No. 22 64 633 discloses an apparatus wherein a continuously supplied web of coherent panels of paper or the like is converted into a zig-zag formation by two roller chains disposed at opposite sides of the path along which the web is supplied. The chains cooperate in such a way that they alterately engage successive panels of the running web to form a succession of transversely extending fold lines with the resulting conversion of the web into a continuously growing stack consisting of panels in zig-zag formation. Each chain is provided with alternating gripping and folding strips which extend transversely of the path of movement of the web. Successive folding strips of one chain cooperate with successive gripping strips of the other chain and vice versa. This entails the conversion of the web into a zig-zag formation of superimposed panels.

German Offenlegungsschrift No. 25 33 434 discloses a different apparatus wherein the means for converting a running web into a succession of panels in zig-zag formation comprises two driven rollers. The rollers rotate around suction chambers and are arranged to attract alternate panels of the running web. The attracted panels are caused to move sideways along arcuate paths which conform to the peripheries of the respective rollers. Consequently, the distance between the level of engagement of successive panels by the respective rollers and the level of the plane where the rollers release the respective panels is considerably less than the width of a panel as measured in the longitudinal direction of the web. This results in the formation of a stack wherein the overlapping panels tend to assume an undulate shape.

The aforementioned German Offenlegungsschrift No. 22 64 633 further discloses an apparatus for subdivision of a growing stack of panels in zig-zag formation into a succession of discrete stacks wherein each stack contains a predetermined number of panels. The subdividing apparatus comprises a table which is movable into the space between two selected neighboring panels of the continuously growing stack and carries a knife cooperating with a roller so as to sever the web along the fold line which connects the selected panels to each other.

OBJECTS AND SUMMARY OF THE INVENTION

An object of the invention is to provide a novel and improved apparatus which can rapidly convert a continuously advancing web of paper or the like into a stack of panels in zig-zag formation.

Another object of the invention is to provide the apparatus with novel and improved means for converting a continuously growing stack of panels in a zig-zag formation into a series of discrete stacks each of which contains a predetermined number of overlapping panels.

A further object of the invention is to provide a novel and improved method of converting a continuous running web of paper or the like into a succession of stacks wherein the panels of the web are accumulated in zig-zag formation and each stack contains a preselected number of panels.

An additional object of the invention is to provide a zig-zag folding apparatus which occupies little room, which comprises a small number of relatively simple parts, and which can be utilized for conversion of relatively wide or relatively narrow webs as well as of webs which consist of relatively stiff or readily flexible material.

Still another object of the invention is to provide the apparatus with novel and improved means for severing the web along selected fold lines in such a way that the severing operation does not appreciably interfere with the conversion of the web into a succession of panels in zig-zag formation.

A further object of the invention is to provide an apparatus whose output exceeds the outputs of conventional apparatus and wherein the panels of a continuously running web can be converted into stacks of panels in zig-zag formation without any or without appreciable undulation of the panels.

One feature of the invention resides in the provision of an apparatus for converting a continuous web of coherent panels into a series of stacks wherein the panels are accumulated in zig-zag formation. The apparatus comprises means for advancing the web longitudinally in a predetermined direction and along a predetermined path, and folding means for changing the orientation of successive panels of the web in the aforementioned path. The folding means includes first and second endless foraminous conveyors which are disposed at opposite sides of the path and diverge in the predetermined direction, and means for attracting alternate panels of the web to the first and second conveyors with the resulting conversion of a series of such panels into a stack of overlapping panels wherein the neighboring panels are connected to each other by fold lines. The apparatus further comprises first and second spiral conveyors which are disposed downstream of the first and second foraminous conveyors and have circulating portions arranged to engage and advance alternate fold lines of the folded web. The apparatus preferably further comprises stationary first and second stops which are disposed between the first and second foraminous conveyors and the respective spiral conveyors to limit the extent of movement of oncoming fold lines transversely of the predetermined direction as a result of divergence of the foraminous conveyors.

The foraminous conveyors preferably include endless belts having divergent active reaches which flank the predetermined path. The attracting means preferably includes suction chambers which are adjacent the active reaches of the foraminous conveyors. Each active reach is disposed between the predetermined path and the respective suction chamber. The belts are provided with groups of openings in the form of ports, slots or the like, and such groups are spaced apart from one another by distances correspondng to one or more lengths of a panel of the web. The groups of openings in one of the belts are staggered with reference to the groups of openings in the other belt so that a panel which is attracted by one of the belts is not attracted by the other belt and vice versa.

The distance between the two stops, as measured transversely of the predetermined path, preferably equals or approximates the length of a panel, and the length of each active reach also equals or approximates the length of a panel.

Neighboring panels of the web are preferably connected to each other by transversely extending weakened zones (e.g., in the form of rows of perforations or the like) along which the neighboring panels are pivoted to form the fold lines. The active reaches of the foraminous conveyors are arranged to attract alternate panels as well as portions of immediately following panels along the respective weakened zones. Each foraminous conveyor preferably comprises at least one endless toothed belt.

Another feature of the invention resides in the provision of an apparatus for subdividing a web having a series of panels which are stacked on each other in zig-zag formation and wherein the neighboring panels are connected to each other by transversely extending fold lines. The apparatus comprises a pair of spiral conveyors which are disposed at opposite sides of the zig-zag formation and serve to guide and advance alternate fold lines of the zig-zag formation, a separating device in the form of a table or the like which is movable between selected neighboring panels of the zig-zag formation from one side of the formation, means for selectively starting and arresting the spiral conveyor at the one side of the zig-zag formation, and means for severing the web along the fold line which connects the selected panels to each other. Such apparatus preferably further comprises means for advancing the web toward the spiral conveyors from above, a support for the zig-zag formation below the spiral conveyors, and means for moving the support up and down with reference to the spiral conveyors. Such apparatus preferably further comprises means for blowing a compressed gaseous fluid between the selected panels of the zig-zag formation to facilitate opening of the zig-zag formation between the selected panels.

The support preferably comprises a grating which is movable between a raised position and a lower position at a predetermined level, namely a level which is best suited for removal of the separated stack of overlapping panels from the stacking station.

The severing means preferably comprises a knife which is disposed at the other side of the zig-zag formation and means for moving the knife relative to the zig-zag formation. Such apparatus preferably further comprises an elongated guide for the knife. The elongated guide can constitute or comprise a horizontal shaft which extends transversely of the direction of advancement of the web toward the stacking station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
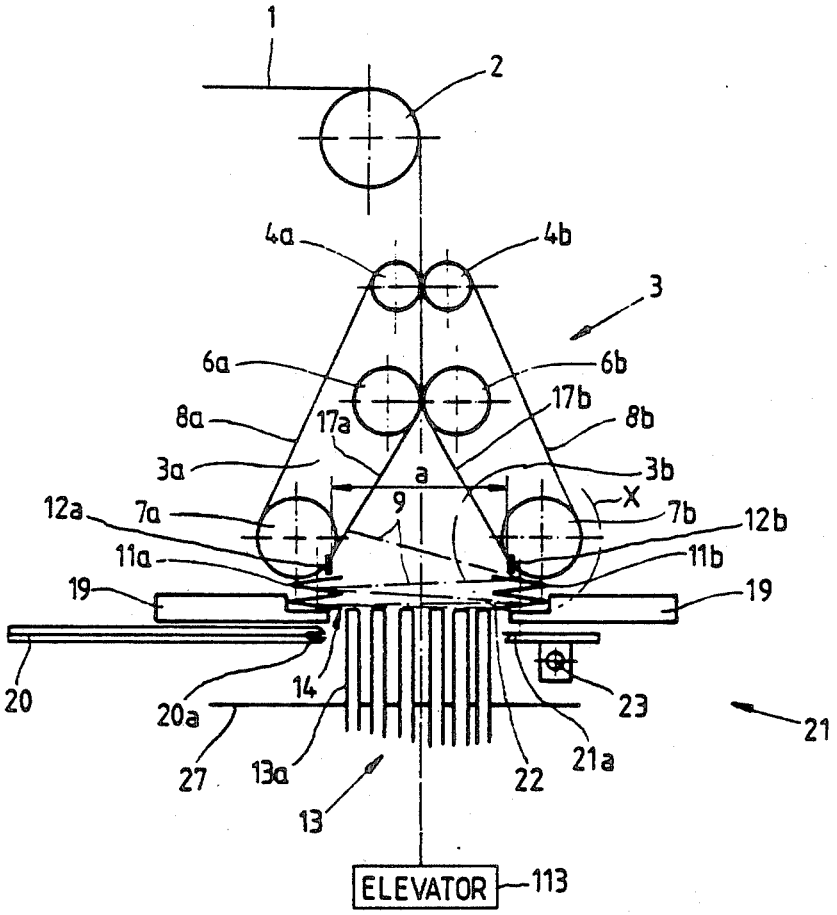
FIG. 1 is a schematic elevational view of a folding apparatus which embodies the invention.

FIG. 1 shows an apparatus wherein a continuous paper web 1 is advanced downwardly along a substantially vertical path by one or more advancing rollers 2 which are driven in a conventional manner, not shown in the drawing. The source of supply of the web 1 comprises means for providing the web with transversely extending rows of perforations constituting weakened zones 10 (FIG. 1*a*) and extending between successive coherent panels 9 having identical widths and lengths. The roller 2 advances successive panels 9 of the web 1 downwardly into the range of a folding device 3 which comprises two mirror symmetrical halves 3*a*, 3*b* having endless foraminous belt conveyors 8*a* and 8*b*. The conveyor 8*a* is trained over pulleys 4*a*, 6*a* and 7*a*, and the conveyor 8*b* is trained over pulleys 4*b*, 6*b* and 7*b*. The flat active reaches 17*a*, 17*b* of the conveyors 8*a* and 8*b* diverge in a downward direction and are adjacent to discrete suction chambers 16 (one shown in FIGS. 1*a* and 1*b*) which attract alternate panels 9 of the running web 1 to the reaches 17*a* and 17*b* so as to convert the web 1 into a zig-zag formation constituting a stack 14 on a support 13 including a horizontal grating 13*a*.

Each conveyor 8*a*, 8*b* can consist of several endless toothed belts which are disposed in parallel vertical planes in a manner customary in the field of transporting paper webs. The internal teeth of the conveyor 8*b* are shown at 18 in FIG. 1*a*. The neighboring panels 9 of the folded portion of the web 1 are connected to each other by transversely extending fold lines 22 each of which coincides with one of the weakened zones 10 of the web.

The apparatus of FIG. 1 further comprises two spiral conveyors 11*a* and 11*b* which are respectively disposed downstream of the active reaches 17*a* and 17*b*, as considered in the (downward) direction of travel of the web 1 from the advancing roller 2 toward the support 13. Each of the spiral conveyors is rotatable about a substantially vertical axis and has one or more helical flights which engage the oncoming alternate fold lines 22 of the zig-zag formation and ensure predictable deposition of successive panels 9 on top of each other in the region between the pulleys 7*a* and 7*b*. The means for selectively starting and arresting the spiral conveyor 11*a* is shown at 111. Such means can comprise a motor and means for starting and arresting the motor at predetermined intervals.

Figure 1A:
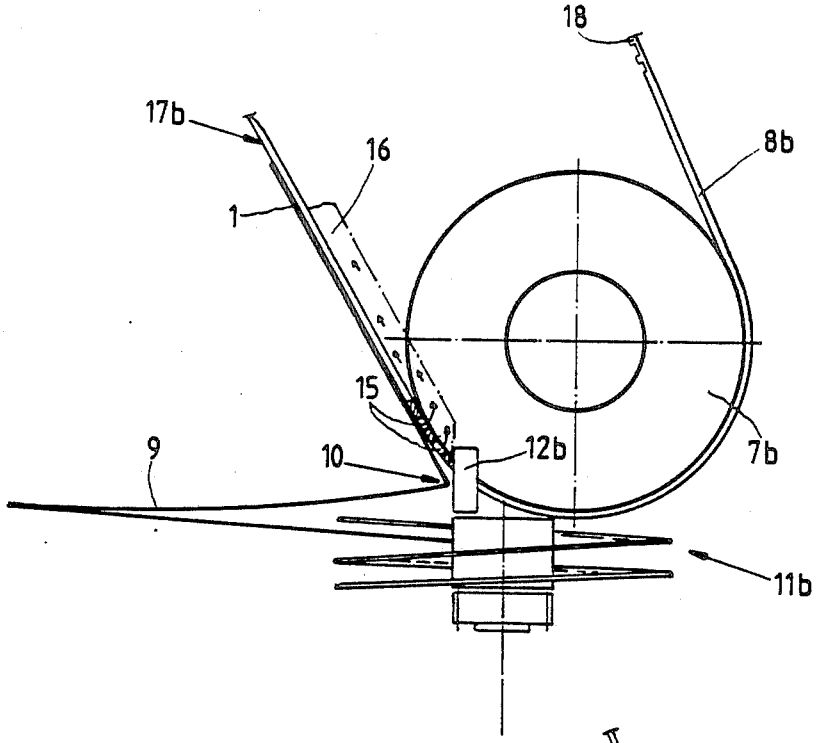
FIG. 1*a* is an enlarged view of a detail within the phantom-line circle X of FIG. 1.
Figure 1B:
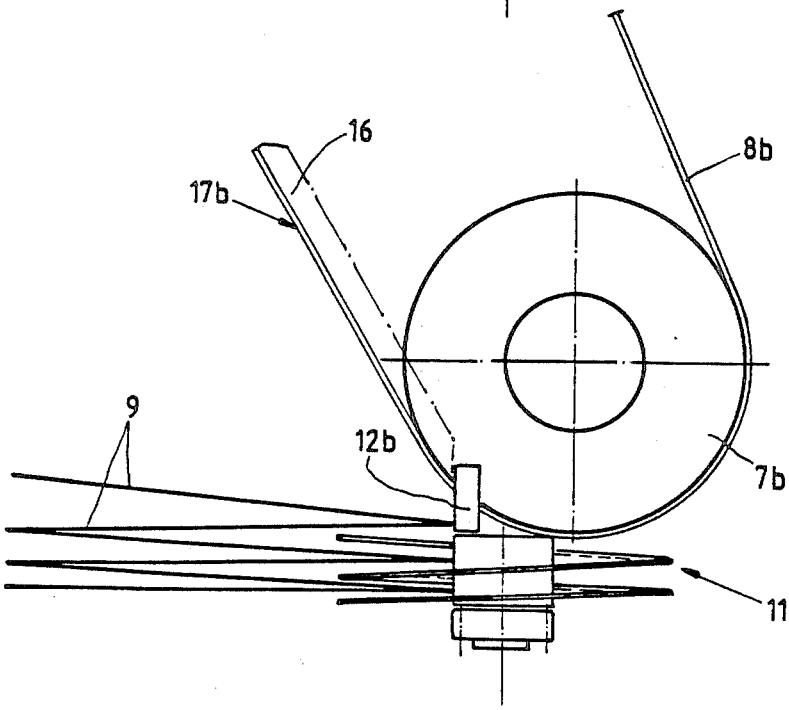
FIG. 1*b* illustrates the structure of FIG. 1*a* but with the leader of the web in a different position.

The apparatus further comprises a first fixed stop 12*a* which is disposed between the lower end of the active reach 17*a* and the nearest flight of the spiral conveyor 11*a*, and a fixed stop 12*b* which is disposed between the lower end of the active reach 17*b* and the nearest flight of the spiral conveyor 11*b*. The distance a between the stops 12*a*, 12*b* (as measured transversely of the direction of advancement of the web 1 downwardly and away from the roller 2) equals or approximates the length of a panel 9 as measured between successive weakened zones 10 of the web 1. The length of each active reach also equals or approximates the distance a so that the area between the pulleys 6*a*, 6*b* and the pulleys 7*a*, 7*b* is bounded by the sides of an equilateral triangle having three sides a. The purpose of the stops 12*a*, 12*b* is to prevent lateral stray movements of fold lines 22 during the last stage of changes of orientation of successive panels 9, namely during the formation of the uppermost portion of the stack 14 of overlapping panels 9 on the grating 13*a* of the support 13. The manner in which the oncoming alternate weakened zones 10 abut and slide along the right-hand fixed stop 12*b* is shown in FIGS. 1*a* and 1*b*. These Figures further show the manner in which the flights of the spiral conveyor 11*b* engage alternate fold lines 22 of the zig-zag formation on the support 13. The flights of the spiral conveyors 11*a*, 11*b* complete the change of orientation of alternate panels 9 following the initial stages of changes of orientation by the active flights 17*a*, 17*b* of the two foraminous conveyors.

FIG. 1*a* shows a group of suction ports or analogous openings 15 in the endless belt conveyor 8*b*. Successive groups of openings 15 are spaced apart from each other in the longitudinal direction of the conveyor 8*b* so that they enable the corresponding suction chamber 16 to attract alternate panels 9 to the active reach 17*b*. The distribution of suction openings in the foraminous belt conveyor 8*a* is analogous except that the groups of suction openings in the conveyor 8*b* are staggered with respect to the groups of suction openings in the conveyor 8*a* so as to ensure that successive oddly numbered panels 9 are attracted to the active reach 17*a* and successive evenly numbered panels 9 are attracted to the active reach 17*b*. The width of each group of suction openings 15 need not equal the length of a panel 9 as measured in the longitudinal direction of the paper web 1. It suffices to provide the conveyors 8*a* and 8*b* with groups of transversely extending suction openings 15 which are assembled into one or more rows close to the leading ends of the respective panels. In order to ensure that such leading ends are properly diverted from the vertical path extending from the roller 2, between the pulleys 4*a*, 4*b* and toward the nip of the pulleys 6*a*, 6*b*, the distance between successive groups of suction openings 15 in the conveyor 8*a* or 8*b* can equal or approximate twice the length of a panel 9. The extent to which groups of suction openings 15 in the conveyor 8*a* are staggered relative to the groups of suction openings in the conveyor 8*b* equals or approximates the length of a panel 9. The arrangement is preferably such that the groups of suction openings 15 attract the respective panels slightly ahead of the respective weakened zones 10 in order to facilitate the conversion of weakened zones 10 into fold lines 22. Each of the suction chambers 16 can comprise one or more channels which are connected with the intake of a suitable suction generating device, not shown.

In contrast to conventional folding apparatus, the active reaches 17*a*, 17*b* are straight and diverge in such a way that they define an angle of approximately 60°. This ensures that the panels 9 are stacked on top of each other without the development of waves. As explained above, conventional apparatus comprise roller-shaped suction conveyors which advance successive panels along arcuate paths with centers of curvature on the axes of the respective suction conveyors.

If each of the conveyors 8*a*, 8*b* comprises several endless bands or belts which are disposed in parallel vertical planes, the stops 12*a*, 12*b* can comprise or constitute comb-like structures with prongs extending into the spaces between the neighboring endless belts or bands of the respective conveyor. Utilization of endless bands or belts which have teeth cooperating with teeth of the respective pulleys is preferred at this time because the conveyors can be driven at a predictable speed without any slippage.

Figure 2:
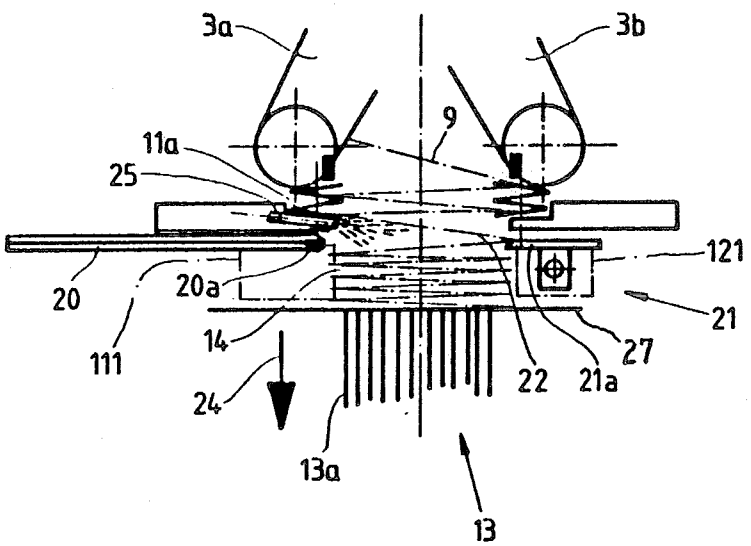
FIG. 2 shows certain parts of the apparatus in the positions they assume during preparation for severing of a fully grown stack from the leader of the remaining portion of the web.
Figure 4:
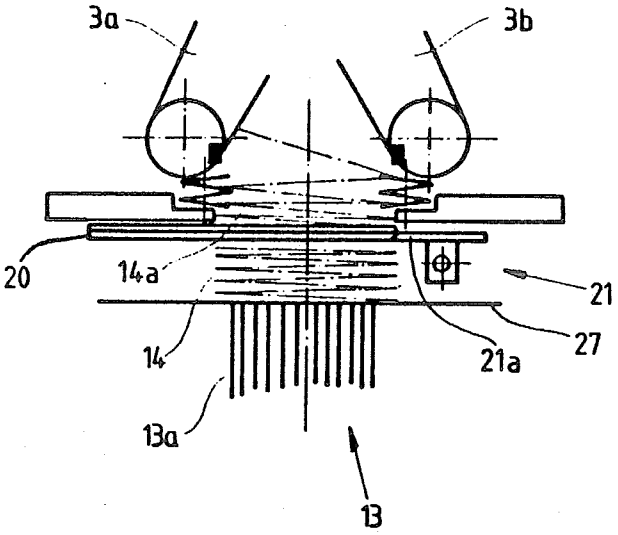
FIG. 4 shows the structure of FIG. 4 with the parts in the positions they assume upon completed separation of a freshly formed stack.

The support 13 is movable up and down by an elevator 113 which is arranged to move the support between the upper end position of FIG. 1 and the lower end position of FIG. 4. In such lower end position, the lowermost panel of a fully assembled stack 14 is located at the level of a horizontal plane 27 in which a pusher or another suitable transfer device (not shown) removes the fully grown stack 14 from the stacking station below the pulleys 7*a*, 7*b*. When in raised position, the support 13 extends to a level slightly above the underside of a stationary frame 19 which supports the shafts of the spiral conveyors 11*a*, 11*b* at the respective sides of the path of downward movement of successive panels 9. The frame 19 is disposed at a level above a horizontally reciprocable separating device in the form of a table 20 having a horizontal slot 20*a* for the edge of a knife 21*a* forming part of a severing device 21. The knife 21*a* and the table 20 are disposed at opposite sides of the support 13, and the knife 21*a* is reciprocable along an elongated horizontal guide member 23 (e.g., a shaft) by a reciprocating device 121 (FIG. 2). This device can constitute a double-acting cylinder and piston unit. The purpose of the knife 21*a* is to sever the web 1 along a selected fold line 22 so as to separate a fully grown stack 14 from the next-following panel preparatory to removal of the freshly separated stack 14 along the surface 27. The knife 21*a* is reciprocable in directions at right angles to the plane of FIG. 1.

Figure 3:
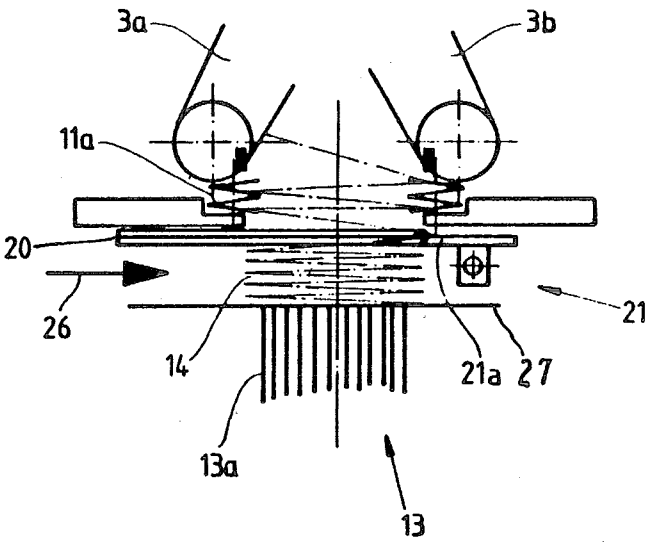
FIG. 3 shows the structure of FIG. 2 in the course of the severing operation.

Severing of the web 1 is preceded by opening of that portion of the web which is adjacent to the slotted side of the table 20. To this end, the apparatus further comprises a nozzle 25 (see FIG. 2) which is operated at intervals to inject one or more streams of compressed gaseous fluid (normally air) between two selected panels 9 at the top of the stack 14 on the support 13. This opens the zig-zag formation in the region of the table 20 so that the latter can be shifted in a direction to the right from the position of FIG. 2 to the position of FIG. 3 before the knife 21*a* is caused to perform a severing stroke in a direction at right angles to the plane of FIG. 3 and to sever the corresponding fold line 22 in order to thus separate the fully grown stack 14 from the next (growing) stack 14*a*. The growing stack 14*a* accumulates initially on the table 20. The direction in which the table 20 is movable into the gap between two selected panels 9 is shown by the arrow 26 (see FIG. 3), and the direction in which the elevator 113 (e.g., a double-acting cylinder and piston unit) can lower the support 13 is indicated by the arrow 24 (FIG. 2). The admission of compressed air between two selected panels 9 provides a gap for introduction of the table 20. The table 20 assumes the position of FIG. 3 in which its slot 20*a* is ready to receive the cutting edge of the knife 21*a* while the knife advances at right angles to the plane of FIG. 3.

Figure 5:
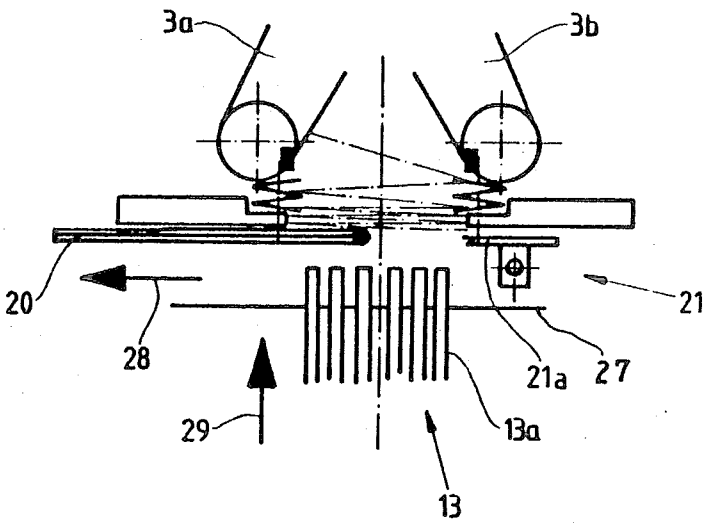
FIG. 5 illustrates the structure of FIG. 4 during the initial stage of the formation of a fresh stack.

The spiral conveyor 11*a* is arrested during severing of the web 1 and is thereupon set in motion again so that its uppermost flight can properly engage the oncoming left-hand fold line 22 of the growing stack 14*a* on top of the table 20. The spiral conveyor 11*a* is restarted before the table 20 is retracted to the position of FIG. 2. An advantage of the just discussed mode of operation is that a fresh stack 14*a* can be formed while the support 13 descends to the position of FIG. 2 preparatory to removal of the fully grown stack 14 from the folding or stacking station. The support 13 is thereupon lifted in the direction of the arrow 29 shown in FIG. 5, and the table 20 is retracted (e.g., by the piston of a double-acting cylinder and piston unit) in the direction of the arrow 28 so that the growing stack 14*a* is transferred from the table onto the grating 13*a* of the support 13. The means 111 for intermittently starting and arresting the spiral conveyor 11*a* can comprise a rapidly actuatable combined clutch and brake, for example, a so-called Danfoss clutch of conventional design. This clutch ensures that the conveyor 11*a* is started at a proper time to ensure optimum engagement of its top flight with the oncoming fold line 22.

The provision of spiral conveyors 11*a*, 11*b* ensures predictable deposition of alternate fold lines 22 and the accumulation of stacks 14 wherein the panels 9 are devoid of waves so that each fully grown stack 14 has a predetermined height. Moreover, the spiral conveyors complete the change of orientation of successive panels 9 so that the neighboring panels are disposed in horizontal planes.

The purpose of the stops 12*a*, 12*b* is to reliably guide the adjacent fold lines 22 during travel from the active reaches 17*a*, 17*b* into the range of the flights on the respective spiral conveyors 11*a*, 11*b*. The stops 12*a*, 12*b* strip the oncoming panels 9 off the respective active reaches 17*a*, 17*b* and they also prevent any lateral stray movements of the panels on their way toward and onto the grating 13*a* or onto the uppermost panel of the growing stack 14*a*. It has been found that the stops 12*a*, 12*b* actively promote the folding of successive panels 9 relative to each other along the corresponding weakened zones 10 so as to convert the weakened zones into fold lines 22.

An important advantage of the improved apparatus is that the spiral conveyor 11*b* can be driven without interruptions and that the spiral conveyor 11*a* is arrested only for very short intervals of time. Such intervals suffice to rapidly advance the table 20 from the position of FIG. 2 to the position of FIG. 3. The apparatus can be provided with a suitable counter which determines the number of panels in a fully grown stack 14 in order to properly time the opening of the nozzle 25 and the movement of the table 20 into the developing gap between two selected neighboring panels 9.

Another important advantage of the improved apparatus is that it can turn out a large number of stacks 14 per unit of time. Furthermore, the formation of successive stacks 14 is predictable and the panels 9 of the stacks remain flat due to the aforediscussed configuration of the active reaches 17*a*, 17*b*, the length of such reaches and the distance a between the stops 12*a*, 12*b*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a web having a series of panels which are stacked on each other in zig-zag formation and wherein the neighboring panels are connected to each other by transversely extending fold lines, comprising a pair of spiral conveyors disposed at opposite sides of the zig-zag formation and arranged to guide and advance alternate fold lines of the zig-zag formation; a separating device arranged to move between selected neighboring panels of the zig-zag formation from one of said sides; means for selectively starting and arresting the spiral conveyor at said one side of the zig-zag formation; and means for severing the web along the fold line which connects the selected panels to each other while the spiral conveyor at said one side of the zig-zag formation is arrested by said means for starting and arresting and the spiral conveyor at the other side of the zig-zag formation continues to be driven, said severing means comprising a knife disposed at the other side of the zig-zag formation and means for moving said knife relative to the zig-zag formation.

2. The apparatus of claim 1, further comprising means for advancing the web from above toward said spiral conveyors, a support for the zig-zag formation below said conveyors, and means for moving said support up and down with reference to said conveyors and with reference to said separating device and said severing means.

3. The apparatus of claim 2, further comprising means for blowing a compressed gaseous fluid between said selected panels of the zig-zag formation.

4. The apparatus of claim 2, wherein said support comprises a grating which is movable by said moving means between a raised position and a lower position at a predetermined level.

5. The apparatus of claim 1, further comprising an elongated guide for said knife.

* * * * *